US008810474B2

(12) United States Patent
Ingalls

(10) Patent No.: US 8,810,474 B2
(45) Date of Patent: Aug. 19, 2014

(54) ANTENNA WITH HIGH K BACKING MATERIAL

(75) Inventor: Mark W. Ingalls, Spring, TX (US)

(73) Assignee: Spectrum Control, Inc., Fairview, PA (US)

( * ) Notice: Subject to any disclaimer, the term of this patent is extended or adjusted under 35 U.S.C. 154(b) by 670 days.

(21) Appl. No.: 12/616,767

(22) Filed: Nov. 11, 2009

(65) Prior Publication Data

US 2010/0141542 A1 Jun. 10, 2010

Related U.S. Application Data

(60) Provisional application No. 61/113,338, filed on Nov. 11, 2008.

(51) Int. Cl.

| | |
|---|---|
| ***H01Q 1/36*** | (2006.01) |
| ***H01Q 13/10*** | (2006.01) |
| ***H01Q 1/40*** | (2006.01) |
| ***H01Q 9/27*** | (2006.01) |

(52) U.S. Cl.

CPC ..... *H01Q 13/10* (2013.01); *H01Q 1/40* (2013.01); *H01Q 9/27* (2013.01)

USPC ..... 343/895; 343/767

(58) Field of Classification Search

USPC ..... 343/767, 872, 873

See application file for complete search history.

(56) References Cited

U.S. PATENT DOCUMENTS

| | | | | |
|---|---|---|---|---|
| 5,815,122 | A * | 9/1998 | Nurnberger et al. | 343/767 |
| 6,137,453 | A * | 10/2000 | Wang et al. | 343/895 |
| 6,943,731 | B2 * | 9/2005 | Killen et al. | 343/700 MS |

OTHER PUBLICATIONS

International Search Report and Written Opinion for PCT/US2009/064072, Jun. 11, 2010, Spectrum Control, Inc. et al.

Ozdemir et al.; "Analysis of thin multioctave cavity-backed slot spiral antennas"; IEE Proceedings—Microwaves, Antennas and Propagation, vol. 146, No. 6; pp. 447-454, Dec. 1999.

* cited by examiner

*Primary Examiner* — Robert Karacsony

(74) *Attorney, Agent, or Firm* — Hodgson Russ LLP

(57) ABSTRACT

An antenna is disclosed. The antenna may have a slotted conductive reference sheet, a first dielectric material and a second dielectric material. The first dielectric material may reside on a first side of the reference sheet, and the second dielectric material may reside on the second side of the reference sheet. The first dielectric material has a first K-value, and the second dielectric material has a second K-value. The second K-value is larger than the first K-value.

18 Claims, 2 Drawing Sheets

ANTENNA WITH HIGH K BACKING MATERIAL

CROSS-REFERENCE TO RELATED APPLICATION

This application claims the benefit of priority to U.S. provisional patent application Ser. No. 61/113,338, filed on Nov. 11, 2008.

FIELD OF THE INVENTION

The present invention relates to antennas having a slotted reference sheet as the radiator of an electromagnetic signal.

BACKGROUND OF THE INVENTION

A slot antenna may be formed when a slot is formed in a conductive sheet (often referred to as a reference plane, and herein referred to as a "reference sheet"). The slot may be formed in the reference sheet by cutting or stamping the reference sheet, or by using a die casting that has features which result in producing a slotted reference sheet from molten material that is allowed to cool in the mold.

Usually, the length of the slot is selected to be half the wavelength of a signal that is produced at a desired frequency. The width of the slot is often a small fraction of the wavelength. The slot may take different shapes. For example, the slot may be a rectangle or a spiral. In the case of a spiral slot, the shape of the spiral slot is selected to provide a specific gain, bandwidth and return loss.

Since the current flow in a slot antenna is not confined to the edges of the slot, the current flows over the entire reference sheet making the antenna a very efficient radiator. This type of antenna normally radiates from both sides of the reference sheet equally. Prior art slot antennas typically take advantage of the radiation pattern from both sides of the reference sheet, or utilize wave guides as a means of directing the radiation emitted from the reference sheet.

SUMMARY OF THE INVENTION

The invention may be embodied as an antenna having a conductive reference sheet, a first dielectric material and a second dielectric material. One or more slots are in the reference sheet. The slot(s) extend from a first side of the reference sheet to a second side of the reference sheet.

The first dielectric material may reside on a first side of the reference sheet, and the second dielectric material may reside on the second side of the reference sheet. The first dielectric material has a first K-value, and the second dielectric material has a second K-value. The second K-value is larger than the first K-value. The reference sheet may contact one or both of the dielectric materials. Also, the reference sheet may be fixed to one or both of the dielectric materials.

BRIEF DESCRIPTION OF THE DRAWINGS

For a fuller understanding of the nature and objects of the invention, reference should be made to the accompanying drawings and the subsequent description. Briefly, the drawings are.

FURTHER DESCRIPTION OF THE INVENTION

Figure 1:
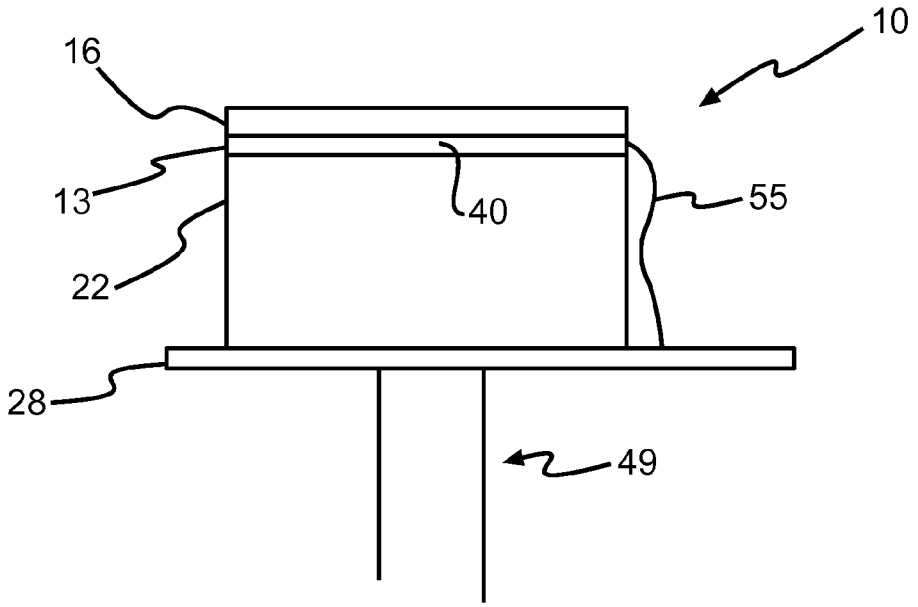
FIG. 1 is a side view of an antenna according to the invention.
Figure 2:
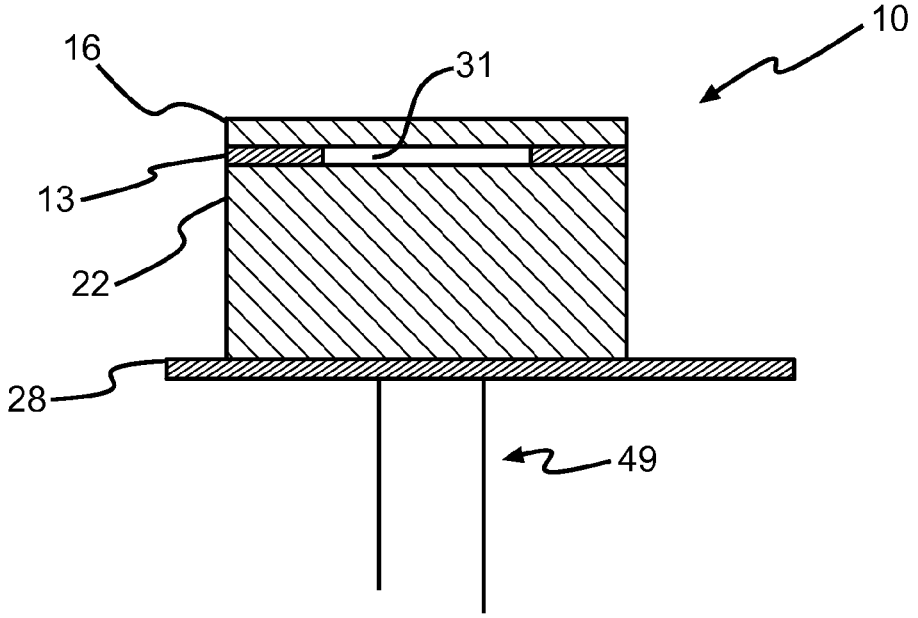
FIG. 2 is cross-sectioned view of the antenna depicted in FIG. 1.
Figure 3:
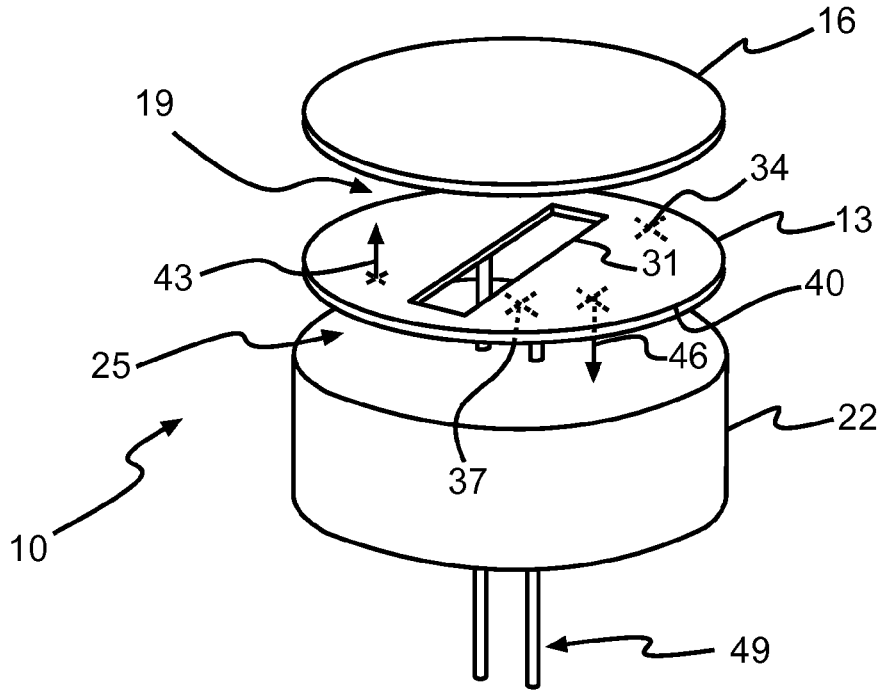
FIG. 3 is an exploded perspective view of part of the antenna depicted in FIG. 1.

FIGS. 1, 2 and 3 depict an antenna 10 that is in keeping with the invention. In FIGS. 1, 2 and 3, there is shown a reference sheet 13 with a first dielectric material 16 on one side 19, and a second dielectric material 22 on another side 25 of the reference sheet. The second dielectric material 22 is shown attached to a grounding structure 28.

The reference sheet 13 has a slot 31, and the reference sheet 13 may be substantially planar. The reference sheet 13 may be a conductive material, such as copper, brass, or a substrate plated with silver or gold. The reference sheet 13 may have a first primary surface 34 and a second primary surface 37. Extending between the primary surfaces 34, 37 is an outer edge 40, which may define an outer boundary of the reference sheet 13. Although the edge 40 may radiate an electromagnetic signal, the edges of the slot 31 are primarily relied on to transmit a signal.

Figure 4:
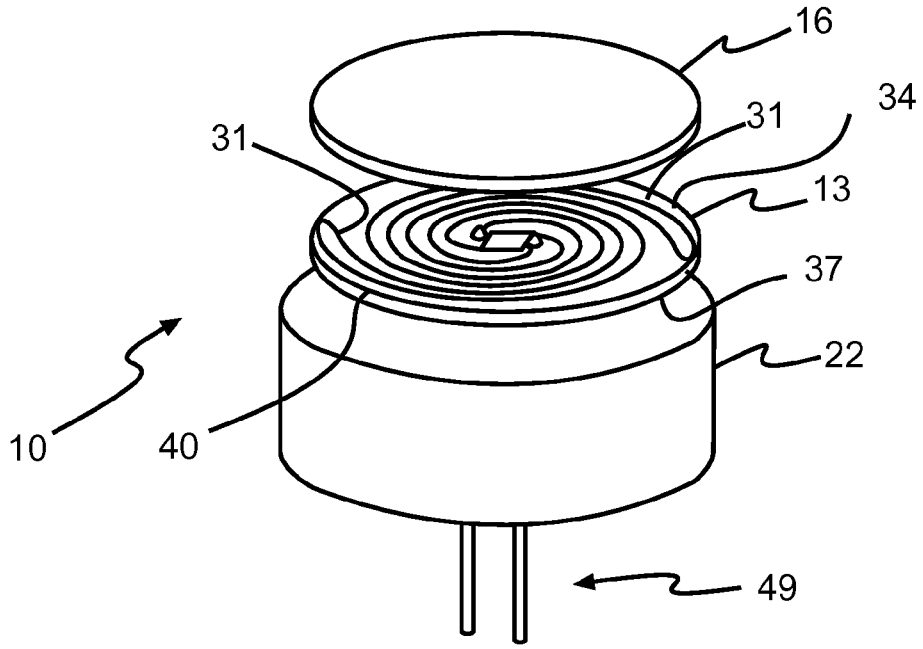
FIG. 4 is an exploded perspective view of another antenna according to the invention.

The slot 31 extends between the first primary surface and the second primary surface 37, and in this manner may by thought of as a hole. FIG. 3 depicts the slot 31 as being substantially rectangular shape, but the slot 31 may have other shapes. For example, the slot 31 may have a substantially spiral shape, such as an Archimedean spiral. FIG. 4 shows an embodiment of the invention in which there are two substantially spiral shaped slots 31. The number of slots 31 and the shape of the slots 31 may be selected to accommodate desired performance characteristics.

The invention includes two dielectric materials 16, 22. The figures show embodiments of the invention in which the first dielectric material 16 and the second dielectric material 22 are positioned on opposing sides 19,25 of the reference sheet 13. The first dielectric material 16 resides on the first side of the reference sheet 13, and the second dielectric material 22 resides on the second side 25 of the reference sheet 13. For clarity, the "first side" 19 of the reference sheet 13 is that side which includes a surface-normal 43 of the first primary surface 34, and the "second side" 25 of the reference sheet 13 is that side which includes a surface-normal 46 of the second primary surface 37. In this manner, a surface-normal 43 of the first primary surface 34 may be thought of as extending into or toward, or thought of as pointing to a location on the first dielectric material 16. Also, a surface-normal 46 of the second primary surface 37 may be thought of as extending into or toward, or thought of as pointing to a location on the second dielectric material 22.

The first and second dielectric materials 16, 22 may be positioned on their respective sides of the reference sheet 13, and air may fill the slot 31. FIG. 1 shows that the first dielectric material 16 substantially covers the first primary surface of the reference sheet 13, and the second dielectric material 16 substantially covers the second primary surface of the reference sheet 13. Also, a portion of the first dielectric material 16 may extend into the slot 31 (and thereby reside in the slot 31) in order to fill all or some of the slot 31 with first dielectric material 16. Alternatively, a portion of the second dielectric material 22 may extend into the slot 31 (and thereby reside in the slot 31) in order to fill all or some of the slot 31 with second dielectric material 22. Or, portions of both dielectric materials 16, 22 may extend into the slot 31 (and thereby reside in the slot 31) in order to fill all or some of the slot 31 with dielectric material. The decision to have the first and/or second dielectric materials 16, 22 reside in the slot may be made by the antenna designer as part of an effort to achieve a desired bandwidth, frequency response and/or gain for the antenna 10.

The reference sheet 13 and dielectric materials 16, 22 are shown in FIG. 3 having cylindrical shapes. However, the invention is not limited to this arrangement. Other shapes may be used. For example, the reference sheet 13, and dielectric materials 16, 22 may be rectangular, oval, triangular, or a non-standard shape. Also, the reference sheet 13 and dielectric materials 16, 22 need not be similar in shape to each other—for example the reference sheet 13 may be square, and the dielectric materials 16, 22 oval.

A signal feed structure 49 may be included in order to provide a pathway along which a signal may be delivered to the reference sheet 13. FIG. 3 shows a signal feed structure 49 comprising two pins that extend through the second dielectric material 22 to contact the reference sheet 13 on opposing sides of the slot 31. FIG. 4 shows a similar signal feed structure 49 wherein each pin contacts the reference sheet 13 at different ones of the spiral slots 31. By providing a signal feed structure 49 that is in communication with the reference sheet 13, signals that are to be broadcasted by the antenna 10 may be efficiently delivered to the reference sheet 13. The reference sheet 13 can be driven with a balanced or an unbalanced load. The signal feed structure 49 may take the form of a pin, or set of pins.

The reference sheet 13 can be electrically ungrounded, or the reference sheet 13 can be grounded directly or capacitatively to a grounding structure 28 via a ground conductor 55. The ground conductor 55 may be provided in communication with the reference sheet 13 for purposes of grounding the reference sheet 13 to the grounding structure 28. The grounding structure 28 may be larger than the reference sheet 13. For example, the grounding structure 28 might be the chassis of an electronic system, the skin of a missile, or the chassis or body of an automobile. The second dielectric material 22 may be positioned to reside between the reference sheet 13 and the grounding structure 28.

One or both of the dielectric materials 16, 22 may contact the reference sheet 13. For example, the first dielectric material 16 may contact the first primary surface 34, and/or the second dielectric material 22 may contact the second primary surface 37. Also, either of the dielectric materials 16, 22, or both, may be fixed to the reference sheet 13. For example, an adhesive may be used to fix a dielectric material 16, 22 to the reference sheet 13.

The first dielectric material 16 has a first K-value, and the second dielectric material 22 has a second K-value. The second K-value is larger than the first K-value. For example, the first and second dielectric materials 16, 22 may be selected so that the first K-value is not greater than one-fourth of the second K-value. In this manner, electromagnetic signals from the reference sheet 13 will radiate more readily via the first dielectric material 16. Also, the high K-dielectric material will shield the reference sheet 13 from the effect of objects that are on the second side 25 of the reference sheet 13.

The first dielectric material 16 may be air, or a polymer, such as Teflon, polypropylene or polyethylene, or materials like epoxy or polyimide (which are often used as the substrate in a printed circuit board). Typically, the first dielectric material 16 has a K-value that is in the range of 3 to 4. The second dielectric material 22 may be alumina or magnesium titanate or barium titanate. Typically, the second dielectric material 22 has a K-value that is in the range of 4 to 90. The second dielectric material 22 may be alumina or magnesium titanate.

By arranging the low-K and high-K dielectric materials 16, 22 on opposite sides 19, 25 of the reference sheet 13, the emitted field is concentrated on the side of the reference sheet 13 facing the low-K dielectric material 16. Also, the effect of any conductive material (such as a ground plane or fasteners) that is behind the high-K dielectric material 22 is minimized by the high-K dielectric material 22. As such, the antenna 10 described herein increases the radiation emitted from the first primary surface 34 of the reference sheet 13. Also, an antenna 10 according to the invention may be fashioned to reduce the effect that conductive material which is placed on the second side 25 of the reference sheet 13 (and in particular, conductive material that is within ¼ wave length of the antenna slot 31) has on the emission pattern of the antenna 10. By using different dielectric materials 16, 22, our antenna 10 achieves a higher directional response than has previously been achieved by slot antennas. Finally, unlike prior art slot antennas, our invention does not require a wave guide if a directional effect is desired.

In lieu of forming the slotted reference sheet 13 from a sheet of material, the reference sheet 13 may be a metalized pattern fixed to one or both of the dielectric materials 16, 22. For example, the reference sheet 13 may be plated, sputtered or silk screened and cured to the high-K dielectric material 22. Alternatively, the reference sheet 13 may be fixed to the low-K dielectric material 22, for example by plating, sputtering or silk screening and curing the metalized pattern to the low-K dielectric material 22. In this manner, assembly of the antenna 10 may be simplified because the reference sheet 13 and one of the dielectric materials 16 or 22 are a unitary piece at the time of assembly. The other dielectric material 16 or 22 may (or may not) be fixed to the unitary piece by use of an adhesive, or other bonding mechanism.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. An antenna, comprising:

a conductive reference sheet having a substantially spiral-shaped slot therein, the reference sheet having a first primary surface and a second primary surface;

a first dielectric material residing on a first side of the reference sheet, the first side being that which includes a surface-normal of the first primary surface, the first dielectric material having a first K-value;

a second dielectric material residing on a second side of the reference sheet, the second side being that which includes a surface-normal of the second primary surface, the second dielectric material having a second K-value, the second K-value being larger than the first K-value; and a grounding structure electrically coupled to the reference sheet.

2. The antenna of claim 1, wherein the first dielectric material resides in the slot.

3. The antenna of claim 1, wherein the first K-value is not greater than one-fourth of the second K-value.

4. The antenna of claim 1, further comprising air in the slot.

5. The antenna of claim 1, wherein the first dielectric material is a polymer.

6. The antenna of claim 1, wherein the first dielectric material is air.

7. The antenna of claim 1, wherein the second dielectric material is alumina.

8. The antenna of claim 1, wherein the second dielectric material is magnesium titanate.

9. The antenna of claim 1, wherein the second dielectric material is barium titanate.

10. The antenna of claim 1, wherein the reference sheet is fixed to one of the dielectric materials.

11. The antenna of claim 1, further comprising a signal feed structure in communication with the reference sheet.

12. The antenna of claim 1, wherein the slot is substantially an Archimedean spiral.

13. The antenna of claim 1, further comprising a ground conductor in communication with the reference sheet.

14. The antenna of claim 13, further comprising a conductive grounding structure in communication with the ground conductor.

15. The antenna of claim 14, wherein the second dielectric material resides between the reference sheet and the grounding structure.

16. The antenna of claim 1, wherein the second dielectric material contacts the second primary surface.

17. The antenna of claim 1, wherein the first dielectric material contacts the first primary surface.

18. The antenna of claim 1, wherein the reference sheet is substantially planar.

* * * * *